United States Patent [19]

Hiwatahi et al.

[11] 4,146,758

[45] Mar. 27, 1979

[54] ROTARY SWITCH ASSEMBLY

[75] Inventors: Kenji Hiwatahi; Masao Ohkita; Masao Michioto; Sadayoshi Iwasaki, all of Furukawa, Japan

[73] Assignee: Alps Electric Co., Ltd., Japan

[21] Appl. No.: 766,444

[22] Filed: Feb. 7, 1977

[30] Foreign Application Priority Data

Feb. 16, 1976 [JP] Japan ..... 51-16510[U]

[51] Int. Cl.[2] ..... H01H 19/54

[52] U.S. Cl. ..... 200/11 DA; 200/14; 200/291

[58] Field of Search ..... 74/527; 200/8 R, 8 A, 200/11 R, 11 A, 11 D, 11 DA, 11 G, 11 J, 11 K, 11 TW, 14, 291, 307, 185, 156, 4

[56] References Cited

U.S. PATENT DOCUMENTS

| | | | |
|---|---|---|---|
| 2,938,987 | 5/1960 | Brown | 200/11 D X |
| 3,226,991 | 1/1966 | Hartsock | 200/156 |
| 3,534,184 | 10/1970 | Tabet | 200/11 R X |
| 3,663,770 | 5/1972 | Groskopfs | 200/11 R |
| 3,736,390 | 5/1973 | Lockard | 200/307 X |
| 3,761,649 | 9/1973 | Jedynak et al. | 200/14 |

FOREIGN PATENT DOCUMENTS

| | | | |
|---|---|---|---|
| 2515846 | 10/1975 | Fed. Rep. of Germany | 200/14 |

OTHER PUBLICATIONS

W. M. Davis; IBM Tech. Disc. Bull., "Wafer Switch", vol. 18, No. 10, Mar. 1976, pp. 3405, 3406.

*Primary Examiner*—James R. Scott
*Attorney, Agent, or Firm*—Guy W. Shoup; Gerard F. Dunne

[57] ABSTRACT

First and second sets of fixed contacts are axially spaced from each other. A rotor disc is axially movable between the contact sets so that electrically conductive patterns formed on opposite sides of the rotor disc selectively engage with the first and second contacts sets respectively. A detent mechanism yieldably holds the rotor disc in engagement with the selected first or second contact set and yieldably holds the rotor disc in one of a plurality of rotational positions in which the pattern interconnects the contacts in the desired manner.

3 Claims, 6 Drawing Figures

ROTARY SWITCH ASSEMBLY

BACKGROUND OF THE INVENTION

The present invention relates to an improved rotary switch suitable for providing 40 or more switching positions.

Rotary switches are commercially available which provide 24 switching positions. In these switches the angular displacement between adjacent switching positions is 15 degrees. It is extremely difficult to fabricate a rotary switch with more than 24 switching positions since, among other reasons, a detent mechanism for yieldably holding the switch rotor in the desired switching position cannot provide positive action due to the small angular spacing.

Whereas citizen's band (CB) transceivers were previously designed to operate on only 24 channels, a new frequency allocation is being placed in effect which provides 40 CB channels. Whereas prior art 24 position rotary switches were suitable for channel switches in the old transceivers, they are clearly inadequate for new transceivers designed to operate on 40 channels. The need for a rotary switch having at least 40 switching positions, which need has existed heretofore, is now becoming quite pressing.

SUMMARY OF THE INVENTION

It is an object of the present invention to provide a rotary switch suitable for providing at least 40 positions and which is ideally suited for use in 40 channel citizen's band transceivers and other electronic devices.

It is another object of the present invention to provide a rotary switch suitable for providing 40 switching positions with greater angular displacement between adjacent switching positions than prior art 24 position rotary switches.

It is another object of the present invention to provide a generally improved rotary switch.

Other objects, together with the foregoing, are attained in the embodiments described in the following description and illustrated in the accompanying drawing.

DESCRIPTION OF THE PREFERRED EMBODIMENTS

While the rotary switch of the invention is susceptible of numerous physical embodiments, depending upon the environment and requirements of use, substantial numbers of the herein shown and described embodiments have been made, tested and used, and all have performed in an eminently satisfactory manner.

Figure 3:
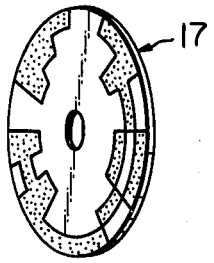
FIG. 3 is a perspective view of a rotor disc of the rotary switch.

Referring now to FIGS. 1 to 5 of the drawing, a rotary switch 11 embodying the present invention comprises a housing 12 rotatably supporting a hollow rotor shaft 13. An operating shaft 14 has a knob 16 at its right end as viewed in FIGS. 1 and 2 and is fixed to the rotor shaft 13 for integral rotation and translation. With particular reference being made to FIG. 3, a rotor disc 17 is formed on its opposite sides with electrically conductive patterns which are not designated by reference numerals, only the pattern on the left side of the rotor disc 17 being visible in the drawing. The rotor disc 17 is fixedly mounted to the rotor shaft 14.

A plurality of first contacts 19, only one contact 19 being shown for simplicity of illustration, are mounted on the inner surface of a left wall **12*a* of the housing 12 facing the rotor disc 17. For use, for example, in a 40 channel CB transceiver, 20 contacts 19 will be mounted on the left wall 12*a* in a circumferentially spaced arrangement with 18 degrees between adjacent contacts 19. In an essentially similar manner, 20 contacts 21 are mounted on the inner surface of a right wall 12*b* of the housing 12**.

Figure 1:
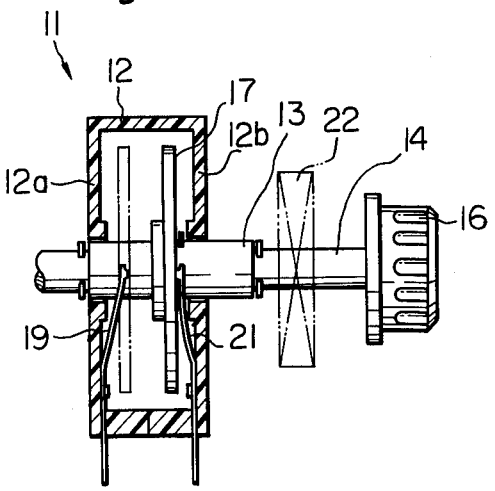
FIG. 1 is a schematic elevational view of a rotary switch embodying the present invention in a first axial position.
Figure 2:
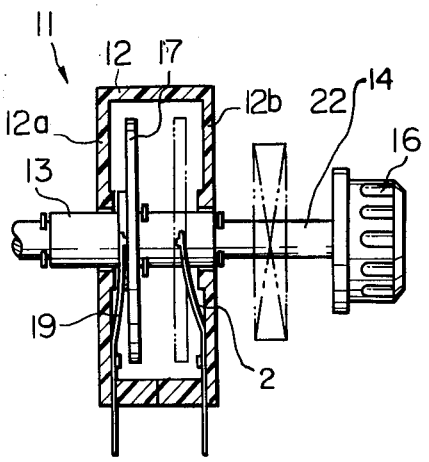
FIG. 2 is similar to FIG. 1 but shows the rotary switch in a second axial position.

In a rightward or solid line position of the rotor disc 17 shown in FIG. 1, the knob 16 is pulled away from the housing 12 so that the electrically conductive pattern on the right side of the rotor disc 17 engages with the contacts 21. In a leftward or solid line position of the rotor disc 17 shown in FIG. 2, the knob 16 is pushed toward the housing 12 so that the electrically conductive pattern on the left side of the rotor disc 17 engages with the contacts 19.

Where the switch 11 is to be employed in a 40 channel CB transceiver, it may be arranged so that the transceiver operator pulls the knob 16 out to select channels 1 to 20 and pushes the knob 16 in to select channels 21 to 40. A detent mechanism 22 provided to the operating shaft 14 yieldably holds the shafts 13 and 14 and thereby the rotor disc 17 in either the rightward position of FIG. 1 or the leftward position of FIG. 2. The detent mechanism 22 also provides 20 rotational detent positions which correspond to the 20 operational switching positions of each of the contacts 19 and 21 with the electrically conductive patterns on the rotor disc 17. To select, for example, channel 15, the operator pulls the knob 16 out to the position of FIG. 1 and then rotates the knob 16 to the position corresponding to channel 15 as indicated by a dial or the like (not shown) associated with the operating shaft 14.

Figure 4:
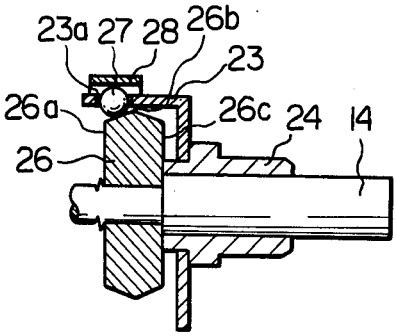
FIG. 4 is a fragmentary sectional view, to an enlarged scale, of a detent mechanism of the rotary switch.
Figure 5:
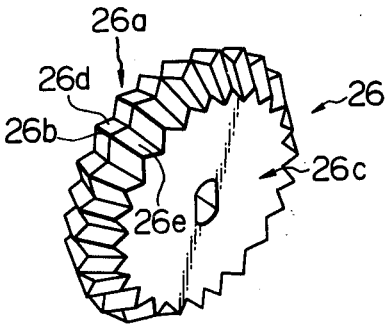
FIG. 5 is a perspective view of a detent disc of the detent mechanism.

With reference being made to FIGS. 4 and 5, the detent mechanism 22 comprises a bracket 23 mounted on a bushing 24 through which the operating shaft 14 rotatably and translatably extends. A detent wheel or disc 26 is fixedly mounted on the operating shaft 14 and has a periphery formed with a triangular cross section defined by a left side **26*a*, a ridge or apex 26*b* and a right side 26*c*. The bracket 23 is bent over at its upper portion and formed with a hole 23*a* in which is retained a ball 27 which serves as a detent member. The ball 17 is pressed against the periphery of the detent disc 26 by a leaf spring 28 mounted on the bracket 23**.

With the ridge **26*b* of the detent disc 26 positioned to the right of the ball 27 as shown in FIG. 4, the detent disc 26 and thereby the rotor disc 17 are yieldably held in their rightward positions. When the knob 16 is pushed in, the detent disc 26 is moved leftwardly so that the ridge 26*b* is positioned to the left of the ball 27 so that the detent disc 26 and rotor disc 17** are yieldably held in their leftward positions.

As shown in FIG. 5, the left side 26*a* of the periphery of the detent disc 26 is formed with 20 equally circumferentially spaced triangular recesses or grooves 26*d*. Similarly, the right side 26*c* of the periphery of the detent disc 26 is formed with 20 grooves 26*e*. With the detent disc 26 in its leftward position, the ball 27 is urged by the leaf spring 28 into one of the grooves 26*e* to yieldably hold the detent disc 26 and rotor disc 17 against rotation. The ball 27 engages in one of the grooves 26*d* when the detent disc 26 and the rotor disc 17 are in their rightward positions. It will be seen that the detent disc 26 provides 20 rotational detent positions and two axial detent positions for the rotor disc 17 corresponding to the switching positions for the switch 11. It is also significant that although the illustrated switch 11 provides 40 switching positions, the angular spacing between adjacent switching positions is 18 degrees in contrast to 15 degrees for the prior art 24 position rotary switches. This increased angular spacing inherently allows more positive detent functioning. Where the prior art technology of providing 24 switch positions is incorporated into the present invention, a 48 position switch is realized with the same angular spacing between adjacent switching positions.

Figure 6:
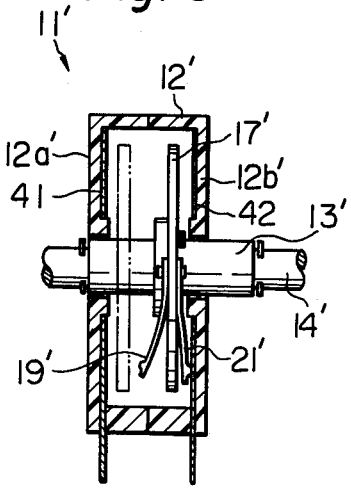
FIG. 6 is similar to FIG. 1 but shows another embodiment of the present rotary switch.

FIG. 6 shows another embodiment of the present invention in which corresponding elements are designated by the same reference numerals suffixed by an apostrophe. A switch 11' differs from the switch 11 only in that contacts 19' and 21' are mounted on the opposite sides of a rotor disc 17' and electrically conductive switch patterns 41 and 42 are formed on the inner surfaces of walls 12*a'* and 12*b'*, the positions of the contacts and electrically conductive patterns being reversed.

Many modifications will become possible for those skilled in art after receiving the teachings of the present disclosure without departing from the scope thereof.

What is claimed is:

1. A rotary switch comprising:

a housing;

first and second contact means respectively spaced from one another within said housing;

a rotatable shaft extending within said housing and supported for axial movement therewithin;

a rotor fixedly secured to said shaft for movement therewith;

third and fourth contact means carried respectively on opposing surfaces of said rotor;

means operatively associated with said shaft whereby said shaft may be axially moved alternatively into a first position where said third contact means on said rotor engage said first contact means or into a second position where said fourth contact means on said rotor engage said second contact means and then said shaft may be rotated to effect desired switching between the engaged contact means; and detent means for yieldably holding said shaft in the selected axial and rotational position, said detent means including a detent wheel operatively associated with said shaft, the periphery of said wheel being generally triangular in cross section with sloping side portions meeting to form a ridge portion, said side portions each being formed with a plurality of circumferentially spaced grooves, and a detent member resiliently urged against the periphery of said wheel, whereby said detent means will hold said shaft in the rotational and axial position selected.

2. A rotary switch according to claim 1, wherein said first and second contact means are each constituted by a plurality of contacts, and the third and fourth contact means are constituted by electrically conductive patterns carried respectively on the opposing sides of said rotor.

3. A rotary switch according to claim 1, wherein said first and second contact means are each constituted by electrically conductive patterns carried respectively by opposing side walls of said housing, and said third and fourth contact means are constituted by a plurality of contacts.

* * * * *